US006155895A

United States Patent [19]

Sato et al.

[11] Patent Number: 6,155,895

[45] Date of Patent: Dec. 5, 2000

[54] COOLING ARRANGEMENT FOR ENGINE

[75] Inventors: Takayuki Sato; Masahiko Kato; Hitoshi Motose, all of Hamamatsu, Japan

[73] Assignee: Sanshin Kogyo Kabushiki Kaisha, Hamamatsu, Japan

[21] Appl. No.: 09/286,764

[22] Filed: Apr. 6, 1999

[30] Foreign Application Priority Data

Apr. 6, 1998 [JP] Japan ..... 10-93066

[51] Int. Cl.[7] ..... B63H 21/38

[52] U.S. Cl. ..... 440/88; 123/195 P

[58] Field of Search ..... 440/88, 900; 123/195 P, 123/196 AB, 196 W

[56] References Cited

U.S. PATENT DOCUMENTS 5,778,847 7/1998 Takahashi et al. ..... 440/88

5,943,996 8/1999 Sogawa et al. ..... 123/195 P

*Primary Examiner*—Jesus D. Sotelo

*Attorney, Agent, or Firm*—Knobbe, Martens, Olson & Bear LLP

[57] ABSTRACT

Several embodiments of V-type outboard motors having direct cylinder injection using electronic fuel injectors driven by a solenoid driver. The solenoid driver is mounted in the otherwise void area between the cylinder banks of the engine. The solenoid driver is also cooled so as to provide long life and good operation. The cooling can be either by air or water or both. Mounting the solenoid driver in the valley between the cylinder banks also permits shortening of the conduits from the solenoid driver to the solenoids of the injector valves for their operation.

20 Claims, 10 Drawing Sheets

COOLING ARRANGEMENT FOR ENGINE

BACKGROUND OF THE INVENTION

This invention relates to a direct injected engine for an outboard motor and more particularly to an improved cooling arrangement for a direct injection system for a two cycle internal combustion engine.

Two cycle engines are widely used, particularly in applications where high specific outputs and relatively uncomplicated, simple engine constructions are desirable. Thus, two cycle engine are frequently employed as the power plant in an outboard motor because of the small space available in the power head of such engines and the demand for relatively high performance.

However, because of environmental concerns, there is a desire to significantly improve the performance of two cycle engines particularly in the area of exhaust emission control. One particularly advantageous method for reducing unburned hydrocarbons in the exhaust system without sacrificing engine performance is through the use of direct cylinder injection.

Although direct cylinder injection is particularly useful in improving engine performance, there are some substantial difficulties in applying it to certain applications, such as outboard motors. One of these has to do with the fact that an outboard motor is quite compact and there is very little room for the added components required by direct cylinder injection. That is, a conventional fuel injection system of the manifold type includes generally a low pressure pump, a high pressure pump, a pressure regulator and a fuel manifolding system for delivering fuel from the supply system to the fuel injectors. With outboard motor applications because of the confined space, it is also the practice to utilize a fuel vapor separator for ensuring that air or vapors cannot be transmitted to the injectors to cause misinjection.

When direct cylinder injection is employed, the type of delivery system utilized with manifold injectors is not sufficient to generate the pressures required for direct cylinder injection. Therefore, it is necessary to employ an additional high pressure pump which is generally a positive displacement, engine driven pump. Thus, the fuel supply system becomes more complex and more complicated, thus further minimizing the space available.

An added problem presented by direct cylinder injection is that the fuel injectors and their control systems become more complicated and more expensive. Although it is desirable to be able to use automotive components, the fact that the engine may be a two-cycle engine requires more injections in a given time period than with automotive, four-cycle applications. Therefore, the power supply for the operation of the fuel injectors tends to generate more heat. In addition, the control of higher pressures requires higher voltages, sometimes as high as 100 volts, in order to operate the injector valve. Thus, there is obviously generated considerable heat.

Therefore, it is essential that some form of cooling system be available for cooling the components of the electrical control for the fuel injectors. Normally, some form of injector driver circuit is utilized for this purpose, and it is important to cool this injector driver so as to ensure continued efficiency and effectiveness of the electrical driving supply.

It is, therefore, a principle object of this invention to provide an improved electrical cooling arrangement for the fuel injectors of a direct injected outboard motor.

It is a further object of this invention to provide an improved cooling arrangement for cooling the injectors of a direct injected, two-cycle outboard motor.

In addition to the heat issue, the use of the higher electrical voltages and the confined location makes it desirable to maintain short leads and conductors between the components of the electrical supply system. This is also dictated, somewhat, by the compact nature of the outboard motor itself.

It is, therefore, a still further object of this invention to provide an improved and compact electrical system for driving the injectors of an outboard motor wherein the length of electrical conduits and the number of connections can be reduced.

In connection with the mounting and location of the injector drivers for an outboard motor, if the engine is of the V-type, as is commonly utilized with outboard motors, it may be advantageous to mount the injector drivers in the valley between the cylinder banks. With two-cycle engines, on the other hand, the exhaust system for the engine is normally formed by manifolds that are formed integrally in the cylinder block in this area. Thus, considerable heat is present which makes it somewhat undesirable to mount the injector drivers in this otherwise available area.

It is a further object of this invention, therefore, to provide an improved mounting and cooling arrangement for the injector drivers of the V-type engine having exhaust manifolds in the valley between the cylinder banks and wherein there is a cooling system for adequately cooling not only the exhaust system but also the injector drivers so they can be mounted in this location.

SUMMARY OF THE INVENTION

This invention is adapted to be embodied in an outboard motor powered by a V-type, multi-cylinder internal combustion engine having a pair of cylinder banks with a valley formed between the cylinder banks. A plurality of fuel injectors are mounted in the engine, each for spraying fuel directly into a respective combustion chamber of the engine. The fuel injectors have electrically operated solenoid valves for controlling the discharge of fuel therefrom. An injector driver is mounted in the valley between the cylinder banks and spaced well between the ends of the engine for supplying electrical power to the fuel injectors for operating their injector valves. A heat exchanger is mounted on an external surface of the injector driver for cooling the injector driver.

DETAILED DESCRIPTION OF THE PREFERRED EMBODIMENTS OF THE INVENTION

Figure 1:
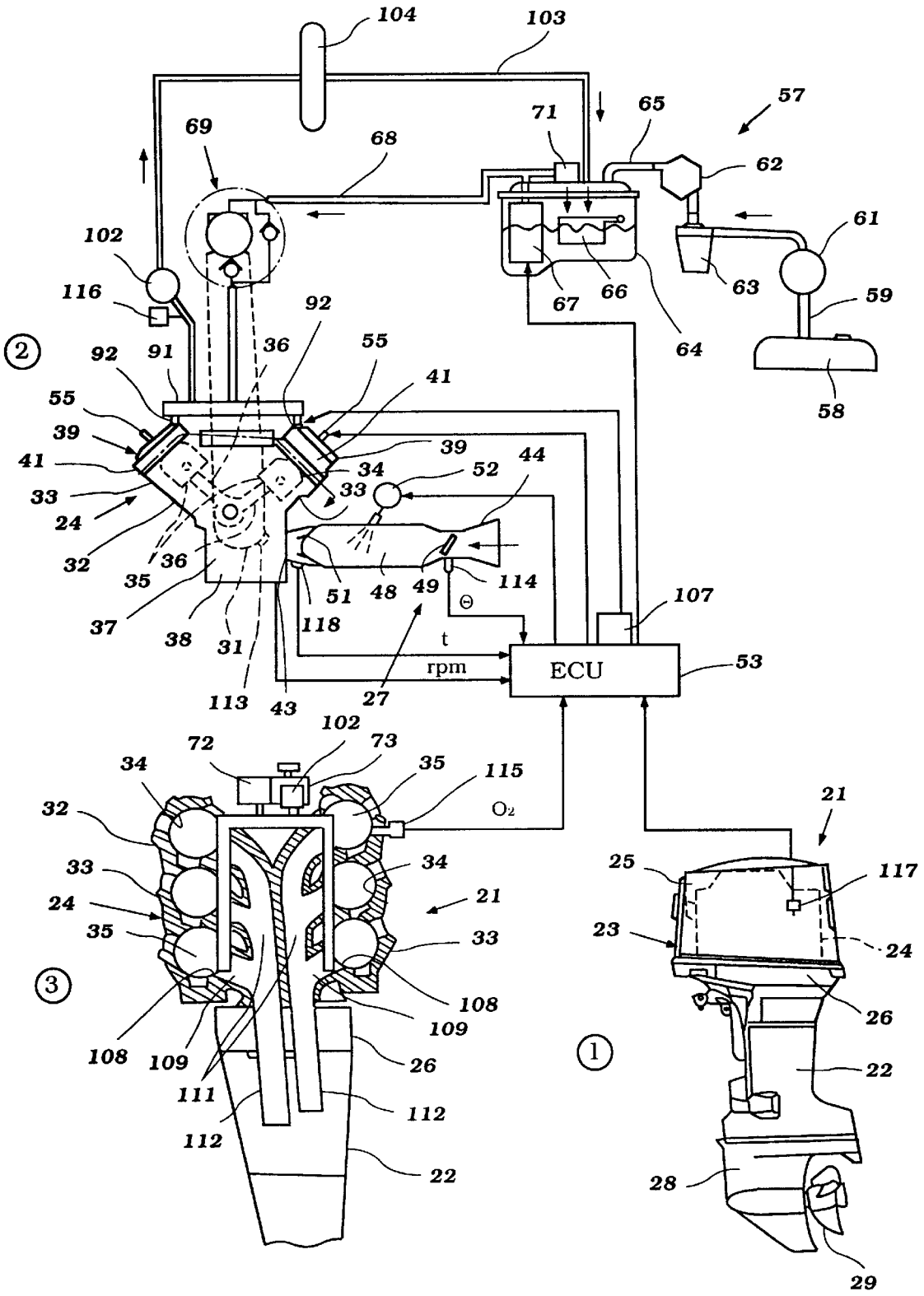
FIG. 1 is a multi-part view showing: (1) in the lower right-hand portion, an outboard motor embodying the invention; (2) in the upper view, a partially schematic view of the engine of the outboard motor with its induction and fuel injection system shown in part schematically; and (3) in the lower left-hand portion, a rear elevational view of the outboard motor with portions removed and other portions broken away and shown in section along the line 1—1 in the upper view so as to more clearly show the construction the engine. An ECU (Electric Control Unit) for the motor links the three views together.

The invention will now be described by referring now in detail to the drawings and initially to the embodiment of FIGS. 1 through 5. In the lower-right hand view of FIG. 1, an outboard motor constructed and operated in accordance with this embodiment is depicted in side elevational view and is identified generally by the reference numeral 21.

The entire outboard motor 21 is not depicted in that the swivel bracket and clamping bracket that are associated with the driveshaft housing, indicated generally by the reference numeral 22, are not illustrated. This is because these components are well known in the art and the specific method by which the outboard motor 21 is mounted to the transom of an associated watercraft is not necessary to permit those skilled in the art to understand or practice the invention.

The outboard motor 21 includes a power head, indicated generally by the reference numeral 23, that is positioned above the driveshaft housing 22 and which includes a powering internal combustion engine, indicated generally by the reference numeral 24. This engine 24 is shown in more detail in the remaining two view of this figure and will be described shortly by reference thereto.

The power head 23 is completed by a protective cowling which includes a main cowling member 25. This main cowling member 25 is detachably connected to a lower tray portion of the protective cowling around an exhaust guide 26 which is and encircles an upper portion of the driveshaft housing 22. The main cowling member 25 has a suitable air inlet arrangement that will be described in more detail later so that air is introduced into the interior of the main cowling member 25 and then goes to an engine air induction system, indicated generally by the reference numeral 27.

Positioned beneath the driveshaft housing 22 is a lower unit 28 in which a propeller 29, which forms the propulsion device for the associated watercraft, is journaled.

As is typical with outboard motor practice, the engine 24 is supported in the power head 23 so that its crankshaft 31 (see the upper view) rotates about a vertically extending axis. This is done so as to facilitate connection of the connection of the crankshaft 31 to a driveshaft (not shown) which depends into the driveshaft housing 22 and which drives the propeller 29 through a conventional forward, neutral, reverse transmission contained in the lower unit 28.

The details of the construction of the outboard motor and the components which are not illustrated may by considered to be conventional or of any type known to those wishing to utilize the invention disclosed herein. Those skilled in the art can readily refer to any known constructions with which to practice the invention.

Figure 10:
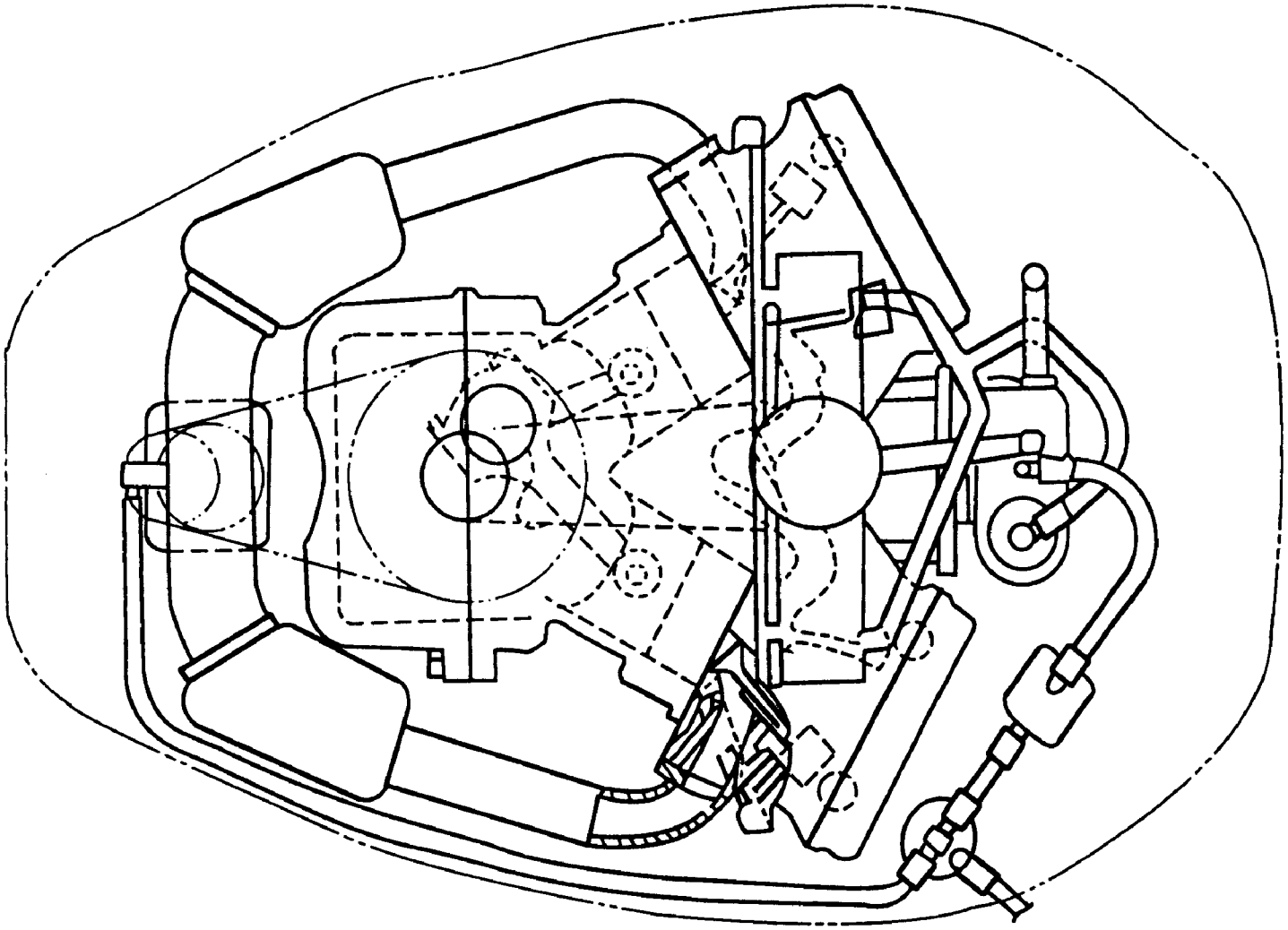
FIG. 10 is a top plan view, in part similar to FIG. 2, of the power head of a third embodiment.

Referring now in detail to the construction of the engine 24 still by primary reference to FIG. 1 although it is shown in more detail in the remaining figures of this embodiment (FIGS. 2–5), in this embodiment, the engine 24 is of the V6 type. The engine 24 operates on a two stroke, crankcase compression principle. Although the invention is described in conjunction with an engine having this cylinder number and cylinder configuration, it will be readily apparent that the invention can be utilized with engines having other cylinder numbers and other cylinder configurations. In fact FIG. 10 shows a four cycle embodiment. Some features of the invention, however, have particular utility in connection with V-type engines.

The engine 24 is comprised of a cylinder block 32 that is formed with a pair of cylinder banks 33. Each of these cylinder banks 33 is formed with three vertically spaced, horizontally extending cylinder bores 34. Pistons 35 reciprocate in these cylinder bores 34. The pistons 35 are, in turn, connected to the upper or small ends of connecting rods 36. The big ends of these connecting rods are journaled on the throws of the crankshaft 31 in a manner that is well known in this art.

The crankshaft 31 is journaled in a suitable manner for rotation within a crankcase chamber 37 that is formed in part by a crankcase member 38 that is affixed to the cylinder block 32 in a suitable manner. As is typical with two stroke engines, the crankshaft 31 and crankcase chamber 37 are formed with seals so that each section of the crankcase that is associated with one of the cylinder bores 34 will be sealed from the others. This type of construction is well known in the art.

A cylinder head assembly, indicated generally by the reference numeral 39, is affixed to the end of the cylinder banks 33 that are spaced from the crankcase chamber 37. These cylinder head assemblies 39 are comprised of a main cylinder head member 41 that defines a plurality of recesses in its lower face. Each of these recesses corporate with the respective cylinder bore 34 and the head of the piston 35 to define the combustion chambers of the engine.

A cylinder head cover member 42 completes the cylinder head assembly 39. The cylinder head members 41 and 42 are affixed to each other and to the respective cylinder banks 33 in a suitable, known manner.

The air induction system 27 is provided for delivering an air charge to the sections of the crankcase chamber 37 associated with each of the cylinder bores 34. This communication is via an intake port 43 formed in the crankcase member 38 and registering with each such crankcase chamber section.

The induction system 27 includes an air silencing and inlet device, shown schematically in this figure (FIG. 1) and indicated by the reference numeral 44. The actual construction of this air charge device appears in FIGS. 2 and 4. In actual physical location, this device 44 is contained within the cowling member 25 at the forward end thereof and has a rearwardly facing air inlet opening 45 through which air is introduced.

Figure 2:
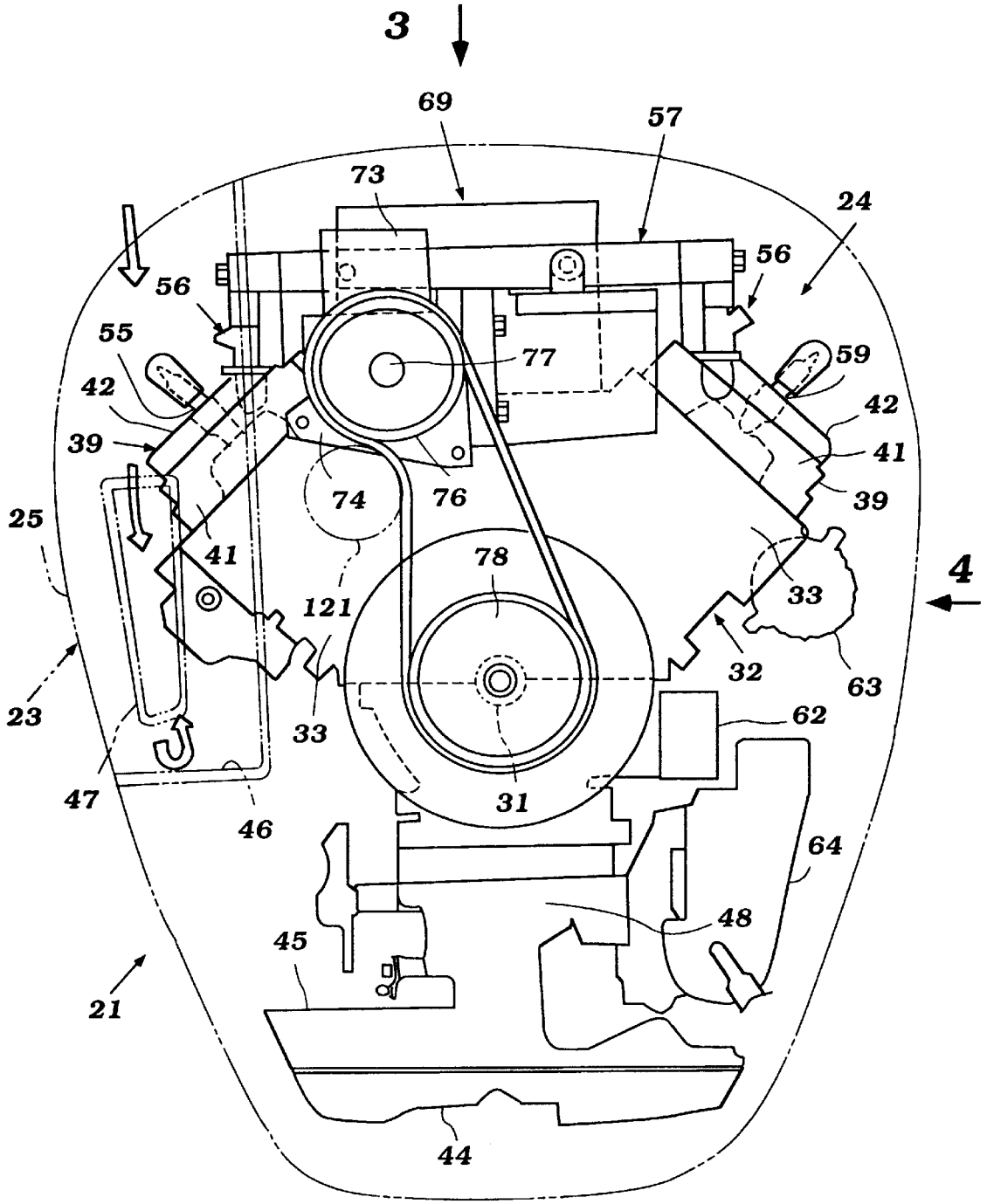
FIG. 2 a top plan view of the power head of a first embodiment showing the engine in solid lines and the protective cowling in phantom.
Figure 4:
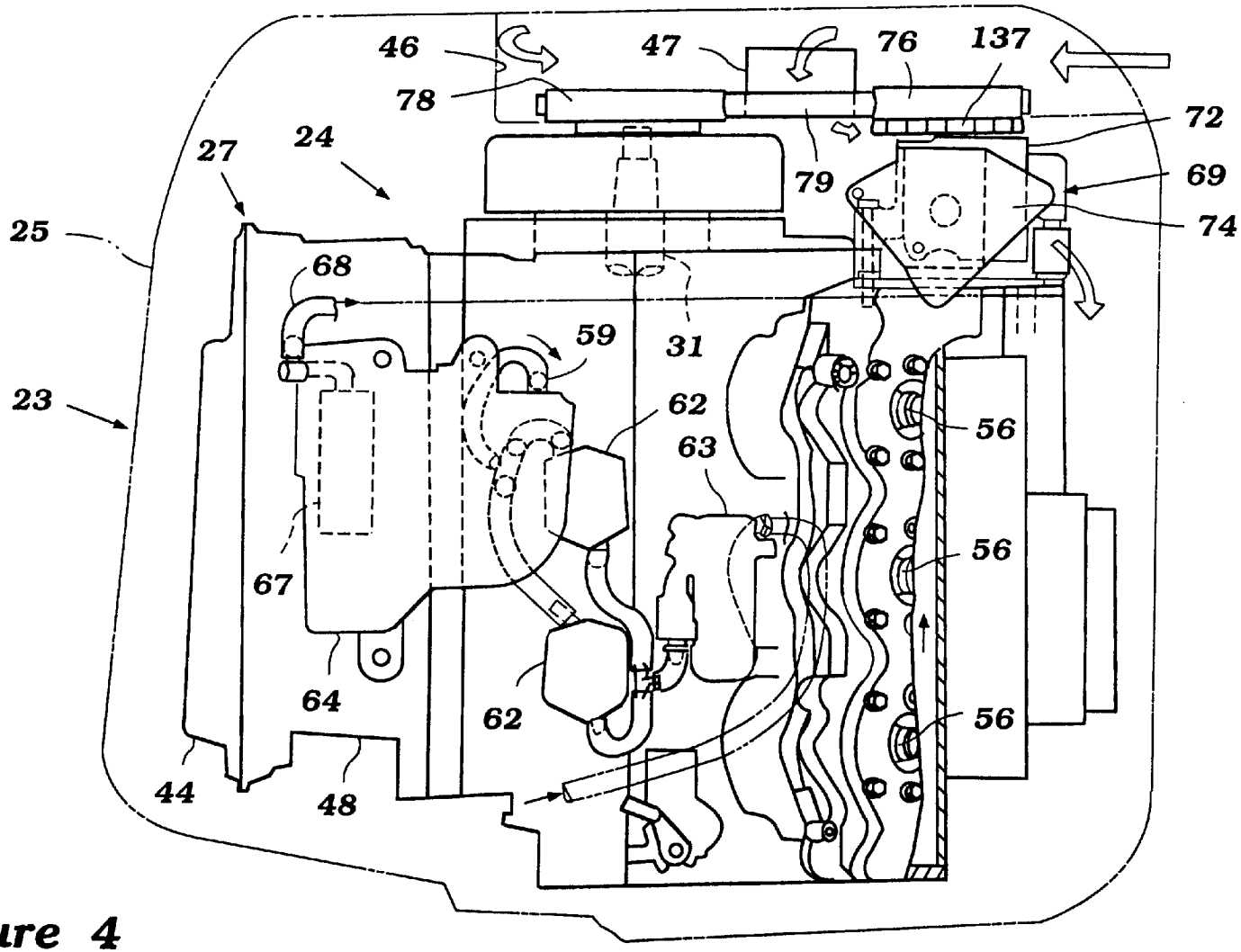
FIG. 4 is a side elevational view of the power head showing the engine in solid lines and the protective cowling in phantom, and is taken in the direction of the arrow 4 in FIG. 2.
Figure 5:
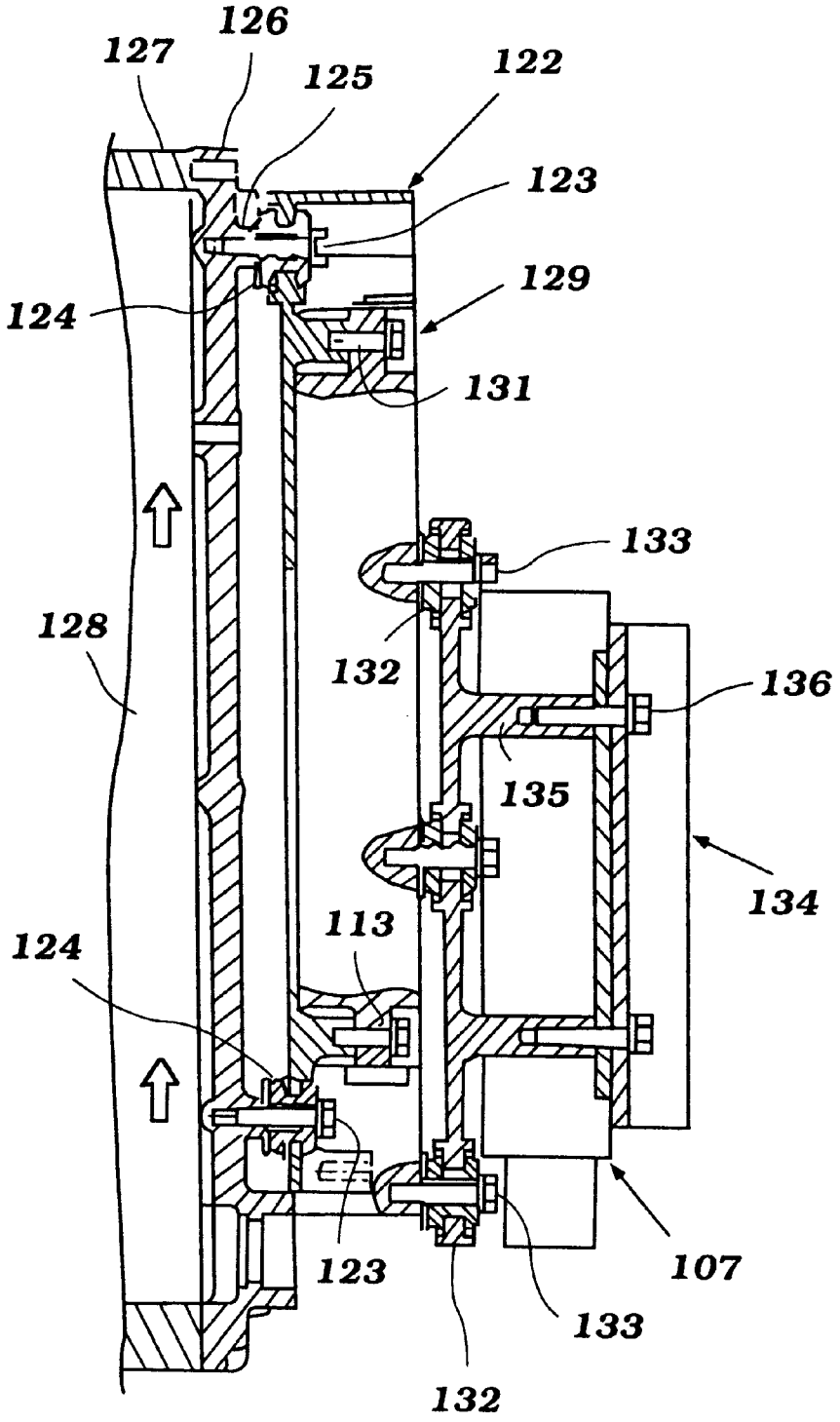
FIG. 5 is a cross sectional view taken perpendicularly to the plane of FIG. 3 and through the center of the valley between the cylinder banks.
Figure 6:
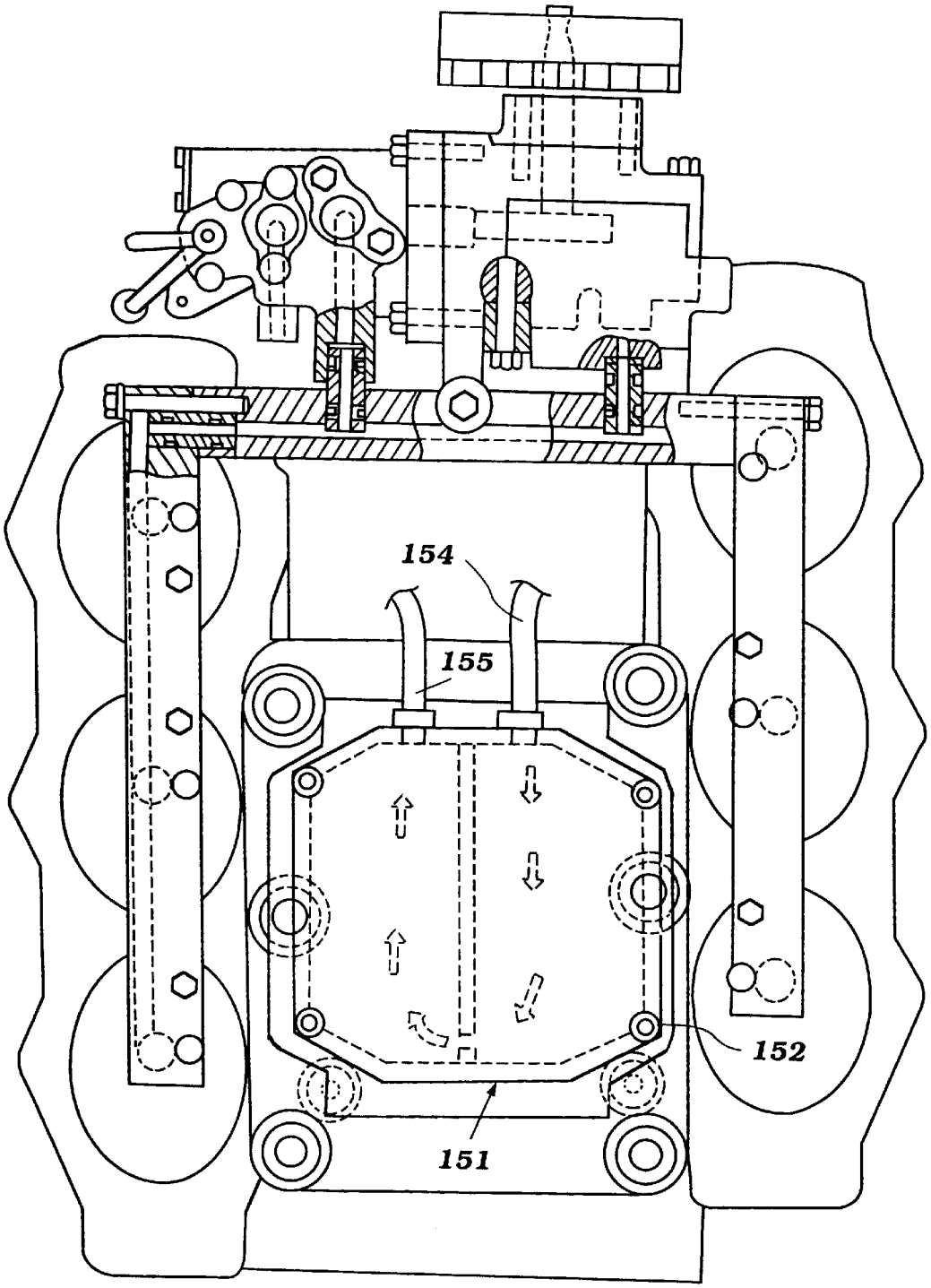
FIG. 6 is a rear elevational view in part similar to FIG. 3, but shows a second embodiment of the invention.
Figure 7:
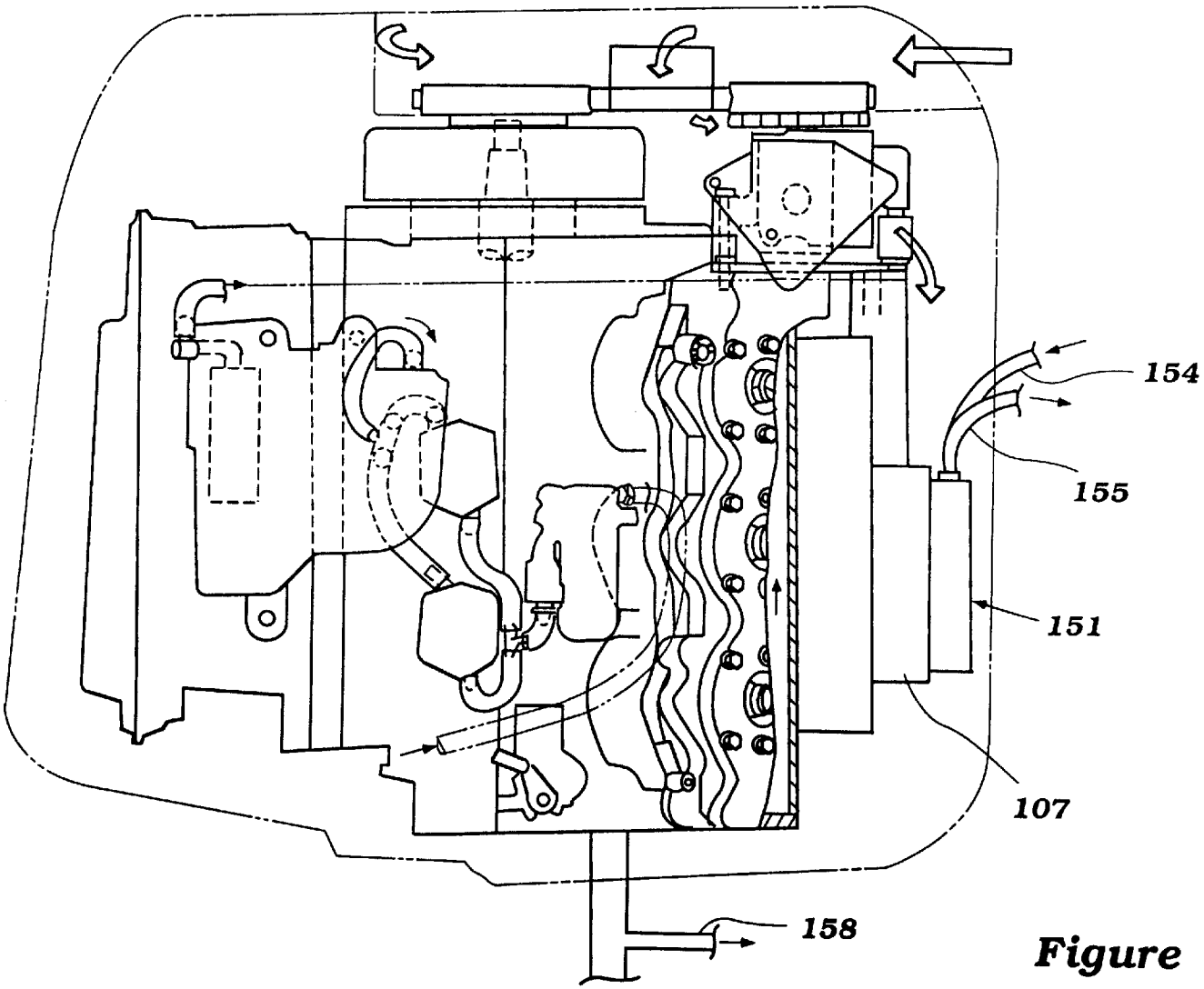
FIG. 7 is a side elevational view in part similar to FIG. 4, but showing the second embodiment.
Figure 8:
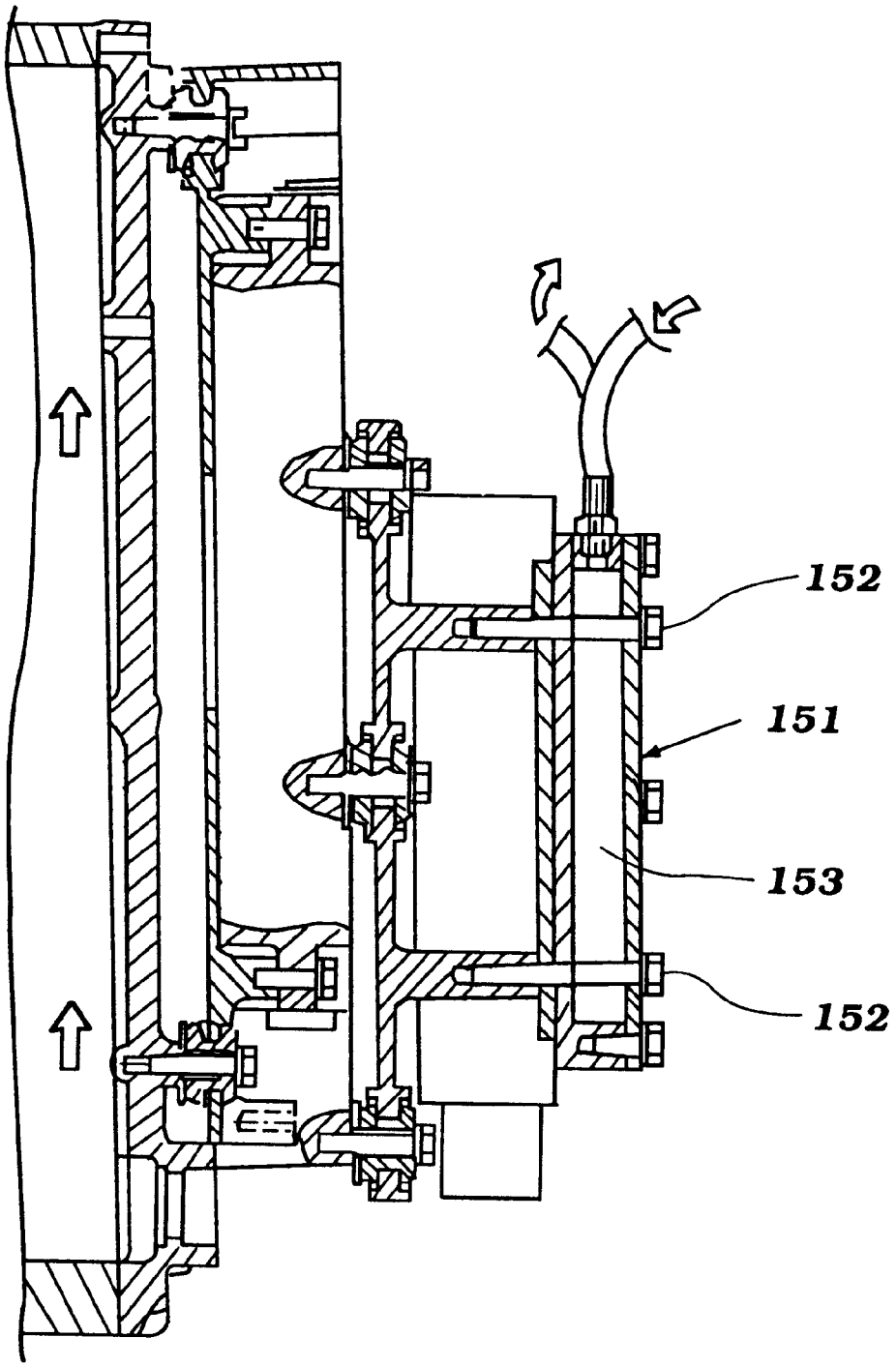
FIG. 8 is a cross sectional view in part similar to FIG. 5, but showing the second embodiment.

The main cowling member 25 is formed with an inlet recess 46 that is shown in phantom in FIGS. 2 and 4 that is partially closed by a cover member to define an atmospheric air inlet opening. The air drawn through this inlet opening enters the interior of the main cowling member 25 through an inlet opening 47 as shown by the arrows in FIGS. 2 and 4.

The air inlet device 44 supplies the induced air to a plurality of throttle bodies or induction devices 48, each of which has a throttle valve 49 provided therein. These throttle valves 49 are supported on throttle valve shafts (not shown). These throttle valve shafts are linked to each other for simultaneous opening and closing of the throttle valves 49 in a manner that is well known in this art.

As is also typical in two cycle engine practice, the intake ports 43 have, provided in them, reed-type check valves 51. These check valves 51 permit the air to flow into the sections of the crankcase chamber 37 when the pistons 35 are moving upwardly in their respective cylinder bores. However, as the pistons 35 move downwardly, the charge will be compressed in the sections of the crankcase chamber 37. At that time, the reed type check valve 51 will close so as to permit the charge to be compressed.

In addition, lubricant pumps 52 are provided for spraying lubricant into the throttle bodies 48 for engine lubrication under the control of an ECU (Electronic Control Unit) 53 that will be described more in detail later. Although it is not shown, some forms of direct lubrication may be also employed for delivering lubricant directly to certain components of the engine.

The charge which is compressed in the sections of the crankcase chamber 37 is then transferred to the combustion chambers as through a scavenging system that terminate in scavenging ports in a manner that is well known.

A spark plug 55 is mounted in the cylinder head assembly 39 for each cylinder bore. The spark plugs 55 are fired under the control of the ECU 53.

The spark plug 55 fire a fuel air charge that is formed by mixing fuel directly with the intake air in the combustion chambers 43 via a respective fuel injector 56. The fuel injectors 56 are solenoid type and electrically operated also under the control of the ECU 53. The fuel injectors 56 are mounted directly in the cylinder head 41 in a specific location, as will be described, so as to provide optimum fuel vaporization or diffusion under all running conditions.

Fuel is supplied to the fuel injectors 56 by a fuel supply system, indicated generally by the reference numeral 57 (see the upper and lower left hand views of FIG. 1). The fuel supply system 57 composes a main fuel supply tank 58 that is provided in the hull of the watercraft with which the outboard motor 21 is associated. Fuel is drawn from this tank 58 through a conduit 59 by means of a first low pressure pump 61 and a plurality of second low pressure pumps 62. The first low pressure pump 61 is a manually operated pump and the second low pressure pumps 62 are diaphragm type pumps operated by variations in pressure in the sections of the crankcase chamber 37, and thus provide a relatively low pressure.

A quick disconnect coupling (not shown) is provided in the conduit 59 and also a fuel filter 63 is positioned in the conduit 59 at an appropriate location within the main cowling member 25 for ease of servicing.

From the low pressure pump 62, fuel is supplied to a vapor separator 64 which is mounted on the engine 24 or within the cowling member 25 at an appropriate location. This fuel is supplied through a line 65. At the vapor separator end of the line 65, there is provided at a float valve (not shown) that is operated by a float 66 so as to maintain a uniform level of fuel in the vapor separator 64.

A high pressure electric fuel pump 67 is provided in the vapor separator 64 and pressurizes fuel that is delivered through a fuel supply line 68 to a high pressure pumping apparatus, indicated generally by the reference numeral 69. The electric fuel pump 67, which is driven by an electric motor, develops a pressure such as 3 to 10 kg/cm$^2$. A low pressure regulator 71 is positioned in the line 68 at the vapor separator 64 and limits the pressure that is delivered to the high pressure pumping apparatus 69 by dumping the fuel back to the vapor separator 64.

The high pressure fuel delivery system 69 includes a high pressure fuel pump 72 that can develop a pressure of, for example, 50 to 100 kg/cm$^2$ or more. A pump drive unit 73 (the lower left hand view) is provided for driving the high pressure fuel pump 72.

Figure 3:
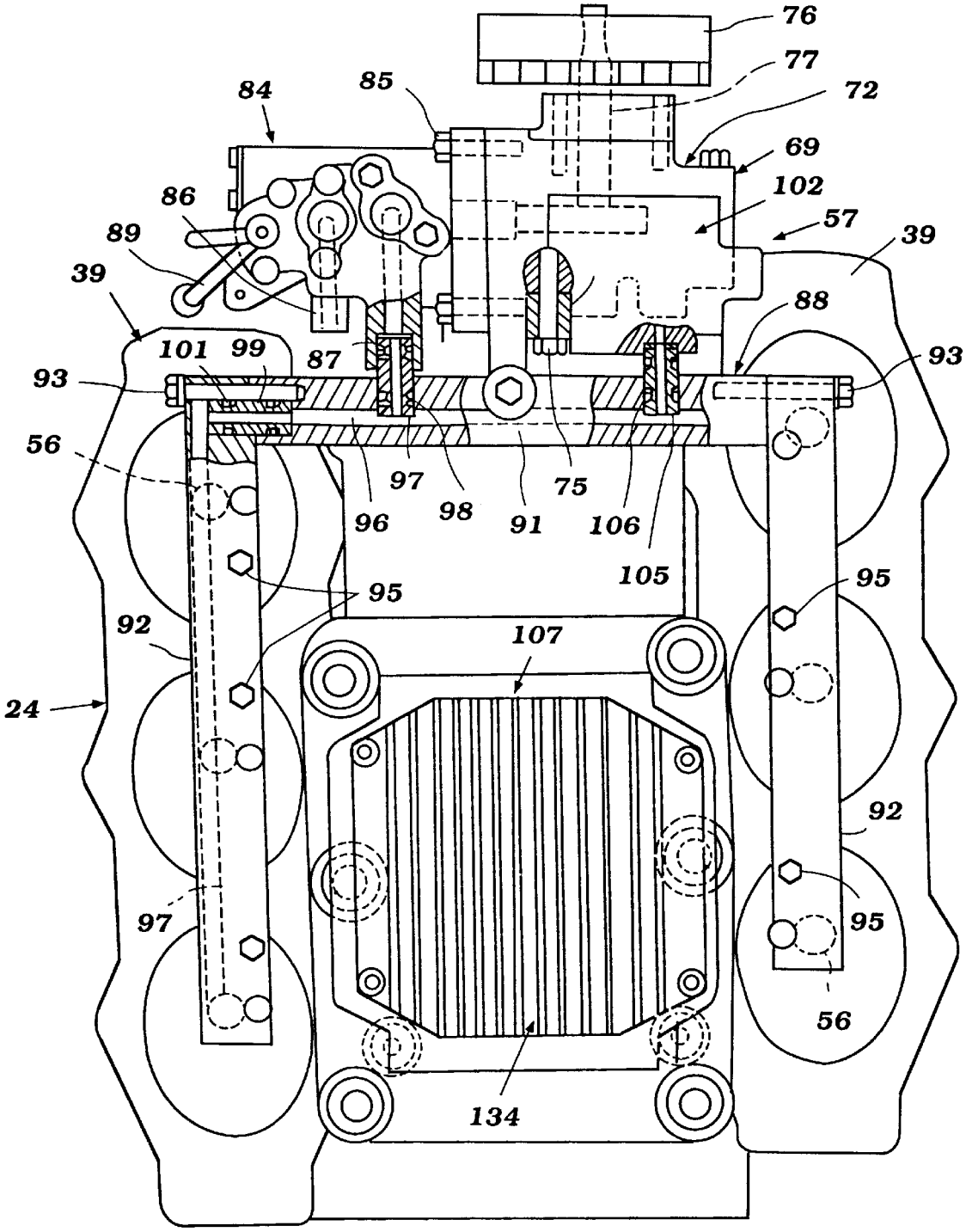
FIG. 3 is a rear elevational view of the engine shown partly in cross-section and is taken generally in the direction of 3 in FIG. 2

Referring to FIGS. 2–4, the pump drive unit 73 is partly affixed to the cylinder block 32 via a mounting plate 74 with bolts 75 and partly directly affixed to the cylinder block 32 so as to overhang between the two banks 33 of the V arrangement.

A pulley 76 is affixed to a pump drive shaft 77 of the pump drive unit 73. The pulley 76 is driven from a driving pulley 78 affixed to the crankshaft 31 by means of a drive belt 79. The pump drive shaft 77 is provided with a cam disc for operating one or more pumping plungers of any known type.

The high pressure fuel pump 72 (FIG. 3) has a unified fuel inlet and outlet module 84 which is mounted on a side wall of the pressure pump 72 by mounting bolts 85. The inlet and outlet module 84 has an inlet passage 86 connected with the line 68 (FIG. 1), an outlet passage 87 connected with a fuel injector supply system indicated generally at 88 and an overflow passage 89 connected with the vapor separator 64 (FIG. 1). The line for returning the overflow fuel to the vapor separator 64 is omitted in FIG. 1.

Fuel is supplied from the high pressure fuel pump 72 to the fuel injector supply system 88. The fuel injector supply system 88 is comprised of a main fuel manifold 91 that extends horizontally. The main fuel manifold 91, in turn, delivers fuel to a pair of vertically extending fuel rails 92. The fuel rails 92 deliver fuel to the fuel injectors 56.

The fuel rails 92 are affixed to the main manifold 91 with bolts 93. Also, the respective fuel rails 92 are affixed to both of the cylinder heads 41 with bolts 95. Thus, the fuel supply conduit 88 is mounted on the engine 24 by means of the pump drive unit 73 via the stay 74, partly directly, at the cylinder body 32 and by means of fuel rails 92 at the cylinder head 41.

The main manifold 91 and the fuel rails 92 are formed with drillings therein to form fuel passages 96 and 97. The fuel passage 96 in the main manifold 91 and the fuel passages 97 in both of the fuel rails are connected to each other in a manner to be described.

The outlet passage 87 of the fuel inlet and outlet module 84 is connected to the fuel passage 96 of the main manifold 91 with a connector 97 (FIG. 3) which is sealed by O-shaped elastic (rubber) rings 98. The main manifold 91 and the fuel rails 92, in turn, are connected together with connectors 99 which are also sealed with the O-shaped elastic rings 101.

The pressure of the fuel supplied by the fuel pump 72 to the fuel injectors 56 is regulated to be the fixed value by a high pressure regulator 102 (See also FIG. 1) which dumps fuel back to the vapor separator 64 through a pressure relief line 103 in which a fuel heat exchanger or cooler 104 is provided. It is important to keep the fuel under the constant pressure. Because the fuel amounts are determined by changes of duration of injection under the condition that the pressure for injection is always the same.

The pressure regulator 102 is also mounted on the pump drive unit 73 with bolts (not shown). The pressure regulator 102 has a passage 104 therein that forms a part of the pressure relief line 103 (FIG. 1) and this passage 104 is connected to the fuel passage 96 in the main manifold 91 with a connector 10 which is also sealed with an O-shaped elastic ring 106.

The fuel injectors 56 are affixed between the fuel rails 92 and the cylinder head assemblies 41 and receive fuel from the fuel rails 92 in a suitable manner. The fuel injectors 56 are of the solenoid operated type and are operated from the ECU 53 via a solenoid driver 107 that is mounted and cooled in accordance with the invention in manners to be described.

Returning back to FIG. 1, after the fuel charge has been formed in the combustion chambers by the injection of fuel from the fuel injectors 56, the charge is fired by firing the spark plugs 55. The injection timing and duration, as well as the control for the timing of firing of the spark plugs 55, are controlled by the ECU 53 in a manner which will be described shortly.

Once the charge burns and expands, the pistons 35 will be driven downwardly in the cylinder bores until the pistons 35 reach the lowermost position. At this time, an exhaust port 108 will be uncovered so as to open the communication with an exhaust passage 109 (see the lower left-hand view of FIG. 1) formed in the valley of the cylinder block 32. The exhaust gases flow through the exhaust passages 109 to manifold collector sections 111 of respective exhaust manifolds that are formed within the cylinder block 32. These exhaust manifold collector sections 111 communicate with exhaust passages formed in the exhaust guide plate 26 on which the engine 24 is mounted.

A pair of exhaust pipes 112 depends from the exhaust guide plate 26 and extend the exhaust passages 109 into an expansion chamber formed in the driveshaft housing 22. From this expansion chamber, the exhaust gases are discharged to the atmosphere through a suitable exhaust system. As is well known in outboard motor practice, this may include an underwater, high speed exhaust gas discharge and an above the water, low speed exhaust gas discharge. Since these types of systems are well known in the art, a further description of them is not believed to be necessary to permit those skilled in the art to practice the invention.

A feedback control system performed by the ECU 53 is provided for realizing a control strategy by which the beginning and duration of fuel injection from the injectors 56 and timing of firing of the spark plugs 55 are controlled. This may be of any known or desired type.

The feedback control system comprises the ECU 53 as a control unit or device and a number of sensors which sense either engine running conditions, ambient conditions or conditions of the outboard motor 21 that will effect engine performance. Certain of the sensors are shown schematically in FIG. 1 and will be described by reference to that figure. It should be readily apparent to those skilled in the art, however, that other types of sensing and control arrangements may be provided.

There is provided, associated with the crankshaft 31, a crankshaft angle position sensor 113 which, when measuring crankshaft angle versus time, outputs a crankshaft rotational speed signal or engine speed signal to the ECU 53.

Operator demand or engine load, as determined by throttle angle of the throttle valve 49, is sensed by a throttle position sensor 114 which outputs a throttle position or load signal to the ECU 53.

A combustion condition or oxygen ($O_2$) sensor 115 is provided that senses the in cylinder combustion conditions by sensing the residual amount of oxygen in the combustion products at a time near the time when the exhaust port is opened. This output and air fuel ratio signal transmitted to the ECU 53.

There is also provided a pressure sensor 116 in line connected to the pressure regulator 102. This pressure sensor 116 outputs the high pressure fuel signal to the ECU 53 (its signal line is omitted in FIG. 1).

There also may be provided a water temperature sensor 117 (see the lower right-hand view) which outputs a cooling water temperature signal to the ECU 53.

Further, an intake air temperature sensor 118 (see the upper view) is provided and this sensor 118 outputs an intake air temperature signal to the ECU 53.

Although these are all sensors shown in FIG. 1, it is, of course, practicable to provide other sensors such as an engine height sensor, a trim angle sensor, a knock sensor, a neutral sensor, a watercraft pitch sensor and an atmospheric temperature sensor in accordance with various control strategies.

The ECU 53, as has been noted, outputs signals to the fuel injectors 56, spark plugs 55, the lubrication pumps 52 and the high pressure electric fuel pump 67 for their respective control. These control signals are indicated schematically in FIG. 1. As noted previously, those skilled in the art may select a suitable control strategy for practicing the invention, which relates to the placement and spray pattern of the injectors 56. In addition, a starter motor for starting the engine 24 and a tensioner 121 for giving tension to the belt 79 are provided (see FIG. 2).

The structure which has thus far been described may be considered to be conventional insofar as the invention in this case is concerned. Thus, the foregoing description is to be considered by those skilled in the art as exemplary only of the environment in which the invention can be employed. The invention deals primarily with the mounting for the injector driver unit 107 in a manner where it will be cooled so that it can enjoy a long life. Also, the injector driver 107 has a fairly substantial bulk and, for that reason, it is necessary or desirable that it be mounted in an otherwise void area.

The area between the cylinder banks 33 does serve this purpose. However, and has been noted, the exhaust manifolds 111 are formed integrally in the cylinder block 33 in this area, and therefore some arrangement should be made for insulating the injector driver 107 from the heat. In addition, it is also desirable to provide an arrangement for cooling the injector driver and that structure will now be described by primary reference to FIGS. 3–5.

A first mounting box, indicated generally by the reference numeral 122, is mounted in the area between the cylinder banks by means of mounting bolts 123 and elastic grommets 124. These mountings are on bosses 125 formed on an extension plate or cover plate 126 that is affixed across and closes a portion 127 of the cylinder block 33.

This area may be disposed adjacent to a cooling jacket 128 of the engine cooling system through which cooling water is circulated. As a result, the heat from the exhaust manifolds 111 will be insulated and the cooling jacket 128 will also provide some cooling for the mounting box 122 and those components carried by it.

A second mounting assembly 129 is mounted within the confines of the mounting box 122 and is fixed there by fasteners 131. The injector driver unit 107 is then mounted on this box 129 by elastic grommets 132 and threaded fasteners 133. Hence, there is substantial resilience in the mounting for the injector driver 107 and it will be well isolated from the heat of the engine.

In addition, a cooling fin arrangement 134 is affixed to the outer surface of the injector driver, and specifically the bosses 135 thereof, by threaded fasteners 136. This cooling fin arrangement 134 has a plurality of vertically aligned fins that project outwardly beyond the cylinder bank and which will be cooled by air that is circulated in a downward direction from fan blades 137 formed integrally on the underside of the fuel pump drive pulley 76.

The air flow from these fan blades 137 appears in FIG. 4 and thus it will be seen that the injector driver 107 is mounted in close proximity to the fuel injectors so as to shorten the length of the leads and also so as to be well cooled. This mounting also is, as previously noted, in an otherwise void area and thus maximum space utilization is enjoyed.

FIGS. 6–9 show another embodiment of the invention which is basically the same as the embodiment already described and, for that reason, a lesser number of views are employed to illustrate this embodiment. Where components of this embodiment are the same as those already described, they have been identified by the same reference numerals and will be described again only insofar as is necessary to understand the construction and operation of this embodiment.

In addition to air cooling, this embodiment also incorporates a water cooler, indicated generally by the reference numeral 151 and which is mounted on the solenoid driver 107 by means of threaded fasteners 152. This cooling device 151 has an internal chamber 153 which may be suitably baffled and to and from which cooling water is delivered by means of a delivery hose 154 and a discharge hose 155. Hence, this device will have even greater cooling capabilities in the embodiment previously described. The path of coolant through the various components of the engine is illustrated schematically in FIG. 9 and will now be described by particular reference to that figure. First, and as is typical with outboard motor practice, a water pump, indicated generally by the reference numeral 156 is provided. This water pump 156 is not shown in the remaining figures, but is driven off of the drive shaft at the interface between the drive shaft housing 22 and the lower unit 28.

Water for cooling the engine is drawn from the body of water in which the watercraft is operated and then is delivered to the engine through a supply conduit 157. The conduit 157 has a first branch 158 which, in turn, is connected to the supply conduit 154 of the cooling device 151. Thus, coolant for cooling the solenoid driver 107 will be delivered to this device without having passed through any of the engine cooling jackets. Thus, this cooling water is delivered at the lowest possible temperature.

The discharge line 155 may be connected directly to the telltale of the outboard motor so that the operator can tell that coolant is being circulated not only through the solenoid driver cooling device 151 but also through the main engine.

Figure 9:
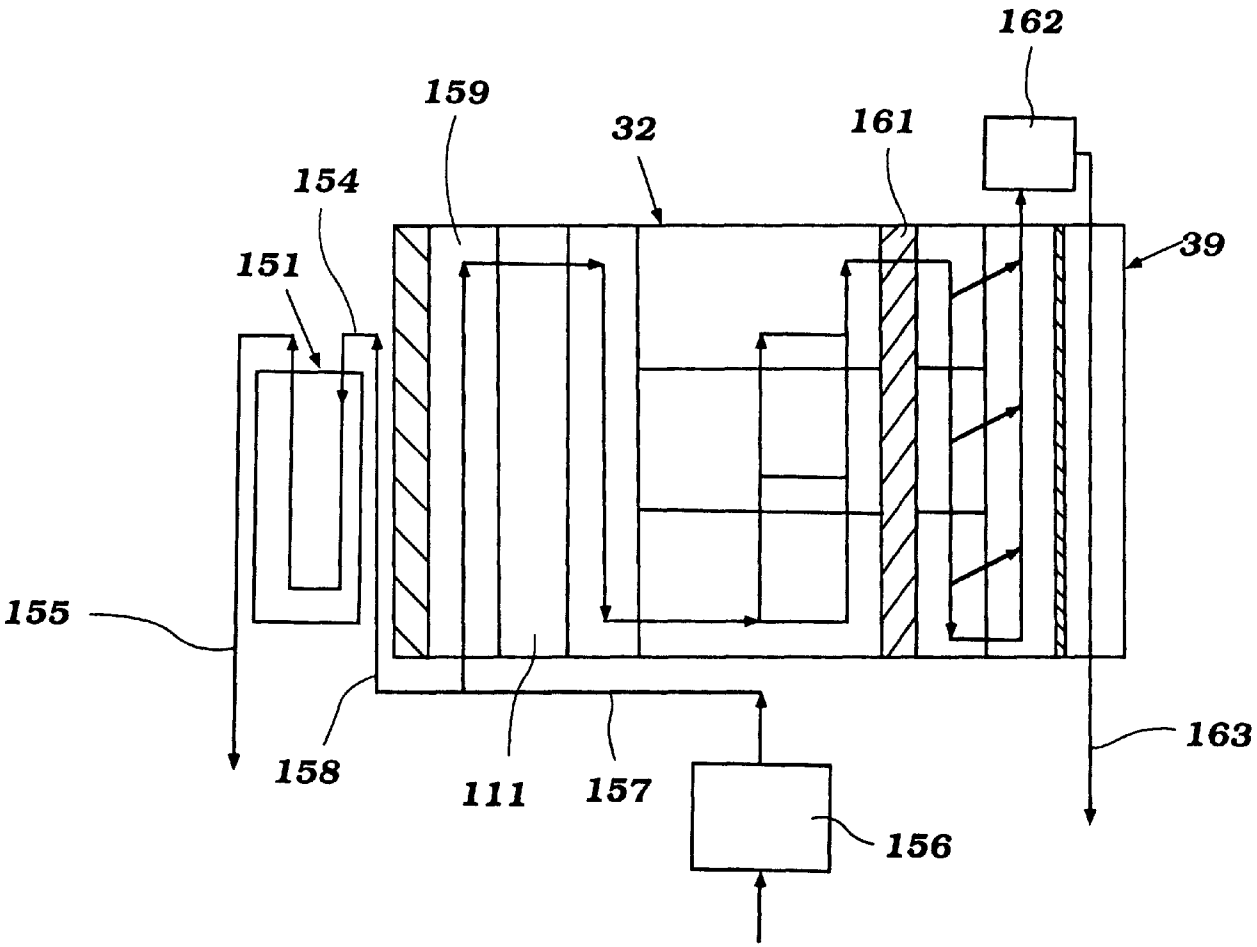
FIG. 9 is schematic flow diagram of the cooling system of the second embodiment.

As also seen in FIG. 9, water is delivered to the engine body 32 and specifically first to the area around the exhaust manifold 111. This portion of the water flow path is indicated in FIG. 9 at 159.

From the exhaust manifold 111, the cooling water is then delivered to the cylinder block and from the cylinder block through a cylinder head gasket 161 to the cylinder head assembly 39 and its cooling jacket.

A thermostat 162 is provided in this line so that flow through the cylinder head 39 will not occur until the water is above a predetermined temperature. This coolant is then dumped back to the body of water in which the watercraft is operating through a return line 163 which may also dump into the expansion chamber of the drive shaft housing for assisting and cooling of the exhaust gases.

It has been previously noted that the invention can be employed in conjunction with four-cycle as well as two-cycle engines. FIG. 10 is an embodiment showing the application of the principle to a four-cycle engine. The specific embodiment illustrated is of the twin overhead cam type and also operates as a V-6 engine. Therefore, and since the internal details of the engine form no part of the invention, further description of this figure is not believed to be necessary to permit those skilled in the art to understand how the invention can be applied to four-cycle engines as well as two-cycle engines.

Of course, the foregoing description is that of preferred embodiments of the invention, and various changes and modifications may be made without departing from the spirit and scope of the invention, as defined by the appended claims.

What is claimed is:

1. A V-type, multi-cylinder internal combustion engine having a pair of cylinder banks with a valley formed between the cylinder banks, a plurality of fuel injectors mounted in said engine, each for spraying fuel directly into a respective combustion chamber of said engine, said fuel injectors having electrically operated solenoid valves for controlling the discharge of fuel therefrom, an injector driver mounted in said valley between said cylinder banks and spaced well between the ends of said engine for supplying electrical power to said fuel injectors for operating their injector valves, and a heat exchanger mounted on an external surface of said injector driver for cooling said injector driver.

2. A V-type, multi-cylinder internal combustion engine as set forth in claim 1 wherein the heat exchanger comprises a plurality of cooling fins.

3. A V-type, multi-cylinder internal combustion engine as set forth in claim 2 further including a fan for circulating air across said cooling fins.

4. A V-type, multi-cylinder internal combustion engine as set forth in claim 3 wherein the fan is driven by the engine.

5. A V-type, multi-cylinder internal combustion engine as set forth in claim 4 further comprising a high pressure pump having a pulley drive from the engine for supplying high pressure fuel to the fuel injectors and wherein the fan is fixed for rotation with the pulley.

6. A V-type, multi-cylinder internal combustion engine as set forth in claim 1 wherein the heat exchanger comprises a cooling jacket through which a coolant is circulated.

7. A V-type, multi-cylinder internal combustion engine as set forth in claim 6 wherein the engine is water cooled and water is the coolant supplied to the heat exchanger.

8. A V-type, multi-cylinder internal combustion engine as set forth in claim 7 wherein the water supplied to said heat exchanger is from the same source as that with which the engine is cooled.

9. A V-type, multi-cylinder internal combustion engine as set forth in claim 8 wherein the water supplied to said heat exchanger has not passed through the engine cooling jacket.

10. A V-type, multi-cylinder internal combustion engine as set forth in claim 1 wherein the engine is formed with an exhaust manifold for receiving exhaust gasses from the engine positioned in the valley and an engine cooling jacket is interposed between said exhaust manifold and the injector driver.

11. An outboard motor having a power head containing an engine as set forth in claim 1 and a driveshaft housing and lower unit depending from said power head and containing a propulsion device driven by said engine, said valley extending vertically in said power head.

12. An outboard motor as set forth in claim 11 wherein the heat exchanger comprises a plurality of cooling fins.

13. An outboard motor as set forth in claim 12 further including a fan for circulating air across said cooling fins.

14. An outboard motor as set forth in claim 13 wherein the fan is driven by the engine.

15. An outboard motor as set forth in claim 14 further comprising a high pressure pump having a pulley drive from the engine for supplying high pressure fuel to the fuel injectors and wherein the fan is fixed for rotation with the pulley.

16. An outboard motor as set forth in claim 11 wherein the heat exchanger comprises a cooling jacket through which a coolant is circulated.

17. An outboard motor as set forth in claim 16 wherein the engine is water cooled and water is the coolant supplied to the heat exchanger.

18. An outboard motor as set forth in claim 17 wherein the water supplied to said heat exchanger is from the same source as that with which the engine is cooled.

19. An outboard motor as set forth in claim 18 wherein the water supplied to said heat exchanger has not passed through the engine cooling jacket.

20. An outboard motor as set forth in claim 11 wherein the engine is formed with an exhaust manifold for receiving exhaust gasses from the engine positioned in the valley and an engine cooling jacket is interposed between said exhaust manifold and the injector driver.

* * * * *